United States Patent [19]

Kunesh

[11] 4,344,840

[45] Aug. 17, 1982

[54] HYDROCRACKING AND HYDROTREATING SHALE OIL IN MULTIPLE CATALYTIC REACTORS

[75] Inventor: John G. Kunesh, Lawrenceville, N.J.

[73] Assignee: Hydrocarbon Research, Inc., Lawrenceville, N.J.

[21] Appl. No.: 232,787

[22] Filed: Feb. 9, 1981

[51] Int. Cl.[3] ..... C10G 47/24

[52] U.S. Cl. ..... 208/59; 208/11 R; 208/48 R; 208/58; 208/89; 208/251 H

[58] Field of Search ..... 208/59, 254 H, 48 R, 208/57, 58, 11 R, 251 H

[56] References Cited

U.S. PATENT DOCUMENTS

| | | | |
|---|---|---|---|
| 3,705,849 | 12/1972 | Alpert et al. | 208/59 |
| 3,773,653 | 11/1973 | Nongbri et al. | 208/89 X |
| 3,788,973 | 1/1974 | Wolk et al. | 208/59 |
| 3,870,623 | 3/1975 | Johnson et al. | 208/108 |
| 3,887,455 | 6/1975 | Hamner et al. | 208/59 X |
| 3,910,834 | 10/1975 | Anderson | 208/59 |
| 3,933,624 | 1/1976 | Myers | 208/89 X |
| 4,022,682 | 5/1977 | Bludis et al. | 208/89 |
| 4,029,571 | 6/1977 | Curtin | 208/89 X |
| 4,054,508 | 10/1977 | Milstein et al. | 208/89 |
| 4,057,488 | 11/1977 | Montagna et al. | 208/89 |

*Primary Examiner*—Delbert E. Gantz
*Assistant Examiner*—G. E. Schmitkons
*Attorney, Agent, or Firm*—Vincent A. Mallare; Fred A. Wilson

[57] ABSTRACT

Raw shale oil containing precipitable inorganic compounds such as iron and arsenic are preheated to below the precipitation temperature and then catalytically hydrocracked in an ebullated bed catalytic reactor. The metal compounds are deposited on the catalyst in the reactor, from which they are withdrawing along with used catalyst which is replaced with fresh catalyst. The reactor effluent is further hydrotreated in a fixed bed catalyst reactor, usually at more severe conditions of 800°–840° F. and 2000–2800 psig, hydrogen partial pressure. The resulting material is phase-separated and distilled to provide jet fuel and diesel oil product meeting commercial and military specifications.

8 Claims, 1 Drawing Figure

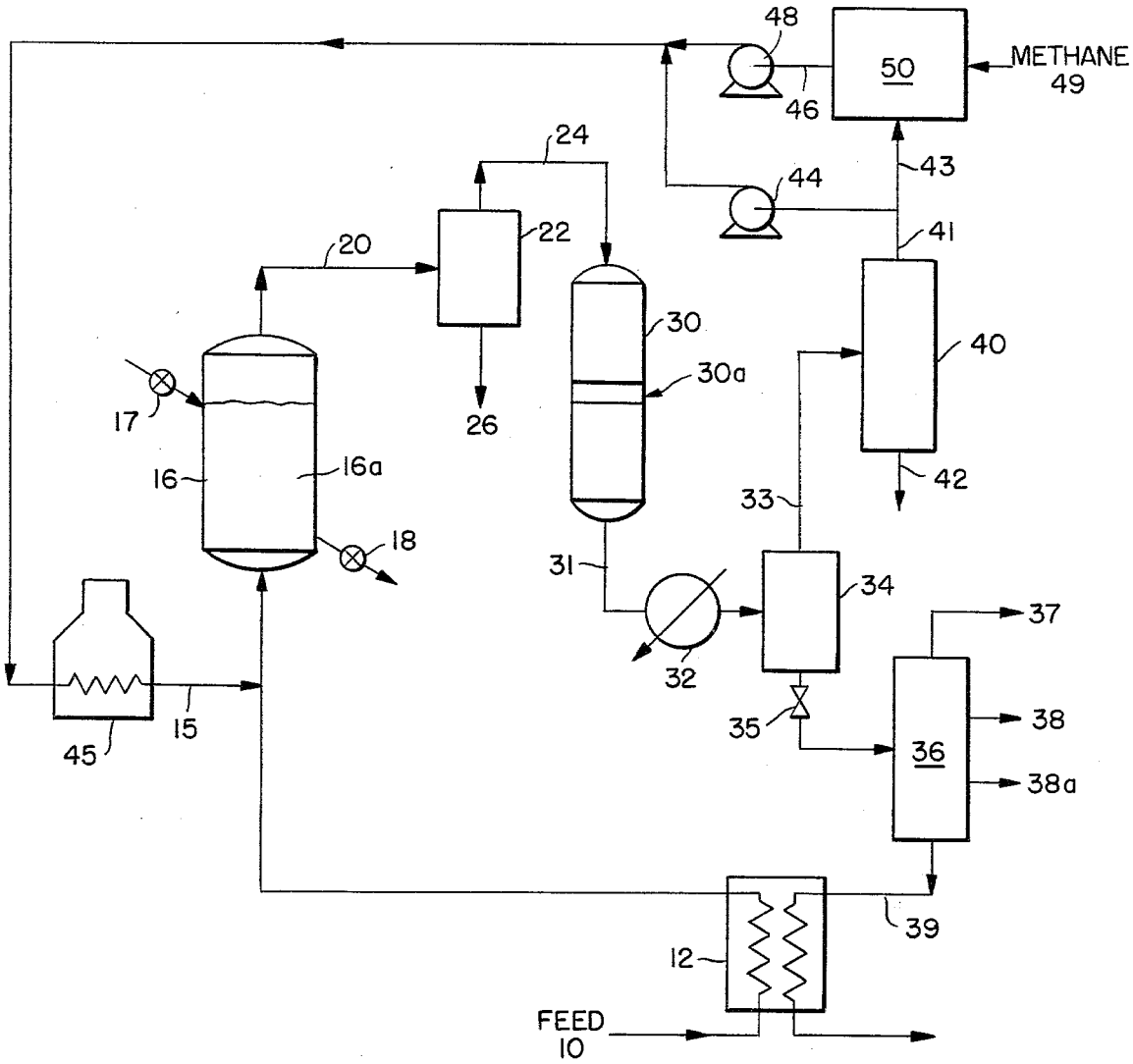
48
50
METHANE
49
46
24
44
43
22
20
41
30
40
30a
17
26
16
16a
42
33
18
31
34
37
32
35
38
36
38a
45
15
39
12
FEED
10

HYDROCRACKING AND HYDROTREATING SHALE OIL IN MULTIPLE CATALYTIC REACTORS

BACKGROUND OF INVENTION

This invention pertains to processing hydrocarbon feedstocks containing precipitable impurities which deposit out during preheating, and particularly to processing raw shale oil containing such precipitable materials to produce catalytically refined liquid fuels.

Attempts to hydrotreat and/or hydrocrack raw shale oil in conventional fixed-bed catalytic reactor operators, usually using multiple beds with quench steps between the beds, have been plagued by operating problems of fouling preheaters, plugging the beds, or both. Such fouling of flow passages and/or catalyst beds is evidently caused by precipitation of inorganic constituents of inorganic/organic complexes contained in the oil, and which decompose at temperatures below the desired hydrogenation reaction temperature. These precipitable inorganic materials contain arsenic and iron compounds and ash which cannot be readily filtered out of the feed stream at near ambient conditions. Shale oil contains small quantities of metals, such as about 60 ppm iron and 10 ppm arsenic, as weakly bonded chemical complexes. These compounds evidently decompose at about 500°-600° F. and precipitate the metal, which deposits on solid surfaces, thereby plugging heater tubes and fixed catalyst beds.

It has been proposed to provide a low temperature guard bed containing particulate solids to remove the metals, and then heat the effluent to the hydrogenation reaction conditions of 700° F. or more required in a second catalytic reactor. However, the deposits occurring in such guard traps cause high pressure drops and even plugging, so that they are inconvenient and expensive to use. Thus, a better solution has been sought for avoiding or preventing such metal compound deposits and fouling problems in processing raw shale oil, so as to permit continous catalytic treating such oils to produce upgraded fuel products.

The multi-stage catalytic processing of heavy petroleum crude oils and residuum is known. For example, U.S. Pat. No. 3,705,849 to Alpert discloses a process for desulfurization of petroleum residuum feedstocks using ebullated catalytic bed hydrogenation reactors in series to reduce hydrogen consumption and increase catalyst life. U.S. Pat. No. 3,773,653 to Nongbri and U.S. Pat. No. 3,788,973 to Wolk dislose similar multistage catalytic conversion processes for petroleum residuum. Also, U.S. Pat. No. 3,887,455 to Hamner discloses a process for hydrotreatment of heavy crudes and residua using ebullated catalytic beds or fixed-bed reactors in series, using catalyst having smaller pore size in the second reactor.

U.S. Pat. No. 4,046,670 to Seguchi discloses a process for thermal cracking heavy petroleum oil in a tubular type heating furnace, and wherein an inorganic substance containing iron oxide is added to the feed as an anti-clogging agent. U.S. Pat. No. 4,181,596 to Jensen discloses treating shale oil retort effluent to lower pour point and reduce contaiminants, such as soluble arsenic and iron, by cooling the effluent and maintaining the liquid phase in a critical temperature range of 600°-800° F. for 1-120 minutes. Also, U.S. Pat. No. 4,158,622 to Schwarzenbek discloses a two-stage hydrogenation process for hydrocarbons such as shale oil containing particulate fines, utilizing an ebullating bed catalytic reactor from which a vapor portion is passed to a stationary bed reactor for further hydrotreatment.

Despite the prior activity, a need still exists for improvements in processing raw shale oil which contains precipitatable inorganic materials and compounds so as to avoid fouling of equipment passages and catalytic beds and provide improved operations. The present invention uses the hydrogenation exotherm in an ebullated bed reactor to eliminate the feed heater and any guard bed, and then finish hydrotreats the light material in a fixed bed catalytic reactor. Inorganic materials are deposited in the ebullated bed reactor on the catalyst, and the deposits are removed from the bed along with the used catalyst.

SUMMARY OF INVENTION

The present invention discloses a process for hydrocracking and hydrotreating hydrocarbon feedstocks which contain precipitable components or contaminants, such as raw shale oil feed, to produce upgraded fuel oils. The hydrocarbon feed is first heated to below the precipitation temperature of the inorganic compound, such as to about 400° F.–600° F., and is then reacted with hydrogen in an ebullating catalytic bed first-stage reaction zone at conditions sufficient to cause some hydrocracking and hydroconversion of the feed and precipitation of the precipitable components in the ebullated catalyst bed. Useful reaction conditions are 700°-860° F. temperature, 1500-3000 psig hydrogen partial pressure, and liquid hourly space velocity of 0.5-3 $V_f/hr/V_r$.

The first reaction zone effluent is passed to a phase separation step, from which the light fraction is preferably further reacted in one or more fixed catalytic bed second-stage reaction zones. Reaction conditions can be similar to the first stage, but are usually at somewhat more severe conditions such as within the range of 750°-850° F. temperature, 2000-2800 psig hydrogen partial pressure and lower space velocity of about 0.5-2.0 $V_f/hr/V_r$. The effluent from the fixed bed reaction zone is then cooled, preferably against the feed stream, and phase-separated. The vapor fraction is treated to remove contaminants prior to recycle, and the heavy fraction is passed to a distillation step, from which is withdrawn a gas stream and product liquid streams suitable for jet and diesel engine fuels.

It should be noted that by employing an ebullated catalyst bed cracking reactor for the initial reaction step, followed by further reaction in one or more fixed bed catalytic reactors, several process advantages are provided. One advantage is that the backmixing ebullated bed cracking reactor utilizes the exothermic heat of reaction to further preheat the feed. This lowers heat transfer temperatures and reduces or eliminates fouling of heater passages in the initial preheater. Also because the ebullated bed catalytic reactor can handle a solids-containing feed, deliberately depositing the feedstock precipitable solids in the ebullating bed from which they can be withdrawn along with used catalyst, eliminates reactor plugging problems.

Another advantage of the present invention is that after such solids removal from the feed, the second stage reaction zone can comprise one or more plug flow fixed bed type catalytic reactors which takes advantage of the better hydrogenation kinetics provided by fixed catalyst beds. If it is desired to operate the second stage reactor at a lower temperature than the ebullated bed cracking reactor, heat can be removed from the effluent streams by useful heat exchange steps between the reactors, which is more desirable than the use of a quenching step in the fixed bed reactor, which is thermally inefficient. A further advantage is that the heavy liquid from the hot separator is substantially free of such precipitated solids, and can be recycled to the ebullated bed reactor if desired.

DESCRIPTION OF THE DRAWING

FIG. 1 is a schematic flowsheet of a two-stage catalytic reaction process for hydrocarbon feedstreams, using an ebullated catalytic reactor upsteam of a fixed catalyst bed reactor.

DESCRIPTION OF PREFERRED EMBODIMENTS

As shown in FIG. 1, raw shale oil feedstock at 10 containing iron and arsenic compounds is heated in heat exchanger 12 to a temperature sufficiently low to avoid precipitation of contained inorganic material such as iron and arsenic compounds. Such heating is usually to at least about 400° F. and usually not above about 600° F., and preferably is against a product oil stream. The warmed feedstream 14 is then introduced with hydrogen from 15 into an ebullated bed catalytic reactor unit 16 containing catalyst bed 16*a*. The reactor has provision for fresh catalyst addition either with the feed at 14*a*, or by addition directly into the reactor at 17, and withdrawal of used catalyst at 18 as shown. Reaction conditions are usually 700°–850° F. temperature, 1500–3000 psig hydrogen partial pressure and liquid hourly space velocity within the range of 0.5–3.0 $V_f/Hr/V_r$. Suitable catalyst is commercially available cobalt-molybdenum or nickel-molybdenum on alumina support and having 0.005 to 0.200 inch particle size range. Used catalyst and deposited solids are withdrawn either from the reactor at connection 18 or with non-vaporized effluent stream 20 from the hot separator 22.

Hot effluent liquid at 20 is phase separated in hot separator 22, and the vapor portion 24 is withdrawn and passed directly to an on-line hydrotreater 30. The liquid portion 26 can be further flashed at reduced pressure for light material recovery and such material combined with stream 24. The residual liquid 28 is either partially recycled to the reactor 16 for further cracking, is further fractionated for recovery of light materials, or burned as fuel.

The vapor and light fractions at 24 introduced directly to downflow fixed bed catalytic hydrotreater 30, usually have additional hydrogen added at 25. In the hydrotreater 30, which may be operated at substantially the same temperature and pressure conditions existing for the reactor unit 16, or usually at somewhat more severe conditions, preferably at 780°–850° F. temperature, 2000–2800 psig hydrogen partial pressure, and space velocity of 0.8–1.3 V/Hr/V, the light fractions are cracked further and virtually completely desulfurized and denitrogenated. Suitable catalyst are cobalt-molybdenum on alumina support having slightly higher metal content than for catalyst bed 16*a*, and having particle size of 0.060–0.250 inch. The fluid temperature will increase through the catalyst bed due to exothermic reaction. If hydrotreater 30 comprises two or more catalyst beds arranged in series, the bed temperatures can be controlled by injecting cooler hydrogen gas between the beds such as at 30*a*.

The resulting product stream 31 from reactor 30 is cooled at 32 against a suitable stream or streams such as water to produce steam, and phase separated at separator 34. The resulting liquid portion is pressure-reduced at 35 and fractionated at 36 into naphtha 37, jet fuel 38, and diesel fuel product streams. The 650° F. + liquid fraction 39 from fractionator 36 can be used to preheat the raw shale oil fed in heater 12 prior to being recycled, or can be sold as heavy fuel oil product.

The effluent vapor fraction at 33 from phase separator 34 can be treated at 40 to remove contaminants such as $H_2S$, $CO_2$, $NH_3$, and $H_2O$ at 42. A portiion of the treated hydrogen-containing gas at 41 is recompressed at 44, heated to 900°–950° F., at fired heater 45, and recycled as stream 15 directly to the reactor 16. The balance of the treated gas 43 from treating step 40 can be stream-reformed at 50, along with natural gas or methane make up at 49, to make additional hydrogen as needed in the process. The additional hydrogen 46 from reformer 50 is recompressed at 48 and joins recycle stream 15.

It is pointed out that the important features of this process for upgrading hydrocarbon feeds such as shale oil are preheating of the feedstock to only about 350° F. to 600° F. temperature range to minimize or prevent precipitation of inorganic material in the preheater passages, then further heating the feed to reaction temperature of 700°–900° F. in an ebullated bed reaction step for initial hydrocracking reaction. Further reaction preferably occurs in an on-line hydrotreating step or steps, which are usually operated at somewhat more severe conditions than for the ebullated catalyst bed reactor, to produce finished liquid fuel products. These process steps as well as other features of the process are applicable to processing coal, heavy oil and tar sand bitumen, as well as for preferably processing of raw shale oil to produce fuel oil products.

This invention is further illustrated by the following examples, which should not be construed as limiting the scope of the invention.

EXAMPLE 1

Upgrading operations are conducted with raw shale oil containing 1.6 W % nitrogen, 20 ppm arsenic, 60 ppm iron and about 0.06 W % ash impurities. The oil is preheated in fired tubular heat exchanger to about 400° F., then passed into an upflow type reactor containing an ebullated bed of commercially available cobalt-molybdenum catalyst extrudate particles. Hydrogen is heated to 900°–910° F. and also introduced into the bottom of the reactor. The reaction zone conditions are maintained within the range of 780°–825° F. temperature, 2000–2500 psig, partial pressure of hydrogen, and space velocity of 1.0 $V_f/hr/V_r$. An effluent stream is removed from the upper end of the reactor and passed to further processing steps. The arsenic and iron compounds or impurities are deposited on the catalyst and are removed from the reactor along with the used catalyst, thus avoiding difficulties with precipitation of such contaminants from the shale oil feed causing increased pressure drop and operating problems in the process, and permitting continuous extended operations.

EXAMPLE 2

The pretreated effluent stream from the ebullated bed catalyst reactor, containing nitrogen content of about 1.27 W %, 0.1 W % arsenic, and sulfur of 0.75 W %, is passed on to a second-stage fixed-bed catalytic reactor for further processing. The oil is hydrotreated at conditions of 800°-840° F. temperature and 2000-2800 psig, partial pressure of hydrogen by passing it over a suitable hydrotreating catalyst, usually nickel-molybdenum on alumina support at space velocity of 1.0 $V_f/Hr/V_r$. The resulting hydrotreated oil product has increased API gravity, nitrogen content of less than about 4 ppm and sulfur content less than about 0.01 W %, thus making it suitable fuel oil for jet and diesel engine use.

Although I have disclosed certain preferred embodiments of my invention, it is recognized that modifications may be made thereto within the spirit and scope of the disclosure and as defined solely by the following claims.

I claim:

1. A process of hydrocracking and hydrotreating heavy hydrocarbon feedstock containing a contaminant compound which precipitates at temperatures below the reaction temperature, which comprises:

(a) preheating the feedstock to temperature below which contaminant precipitation occurs and introducing the heated feed with hydrogen into a first reaction zone containing an ebullated catalyst bed;

(b) reacting the feedstock in the ebullated bed first reaction zone at 700°-860° F. temperature and 1500-3000 psig hydrogen partial pressure conditions, and precipitating the precipitable material in the catalyst in the bed;

(c) passing the reaction zone effluent on to a second reaction zone containing a fixed catalytic bed maintained at 750°-850° F. temperature for further hydrotreating the feed; and (d) recovering a hydrogen-containing gas stream and a hydrotreated liquid product stream.

2. The process of claim 1, wherein the contaminant material precipitated and deposited on the catalyst in step (b) is withdrawn from the ebullated bed catalytic reaction zone along with used catalyst.

3. The process of claim 1, wherein the ebullated bed first reaction zone is maintained at 720°-850° F. temperature and 1800-2800 psig hydrogen partial pressure and the catalyst is cobalt-molybdenum on alumina support.

4. The process of claim 1, wherein the hydrotreated liquid stream in step (d) is fractionated to produce naphtha and fuel oil product suitable for jet fuel.

5. The process of claim 1, wherein the feedstock is preheated to about 350°-550° F. against the warm oil product stream in step (d).

6. The process of claim 1, wherein the gas stream recovered in step (d) is treated to recover a hydrogen stream, which is recycled to the first stage reaction zone, and a gas stream wich is reformed to produce additional hydrogen.

7. The process of claim 1, wherein the feedstock is raw shale oil and the preheating temperature in step (a) does not exceed about 600° F.

8. A process for hydrocracking and hydrotreating heavy raw shale oil feedstock containing a contaminant which precipitates at temperatures below the reaction temperature, which comprises:

(a) preheating the feedstock to a temperature of 400°-600° F. and introducing the heated feed stream with heated hydrogen into a first reaction zone containing an ebullated catalyst bed;

(b) reacting the feedstock in the ebullated bed first reaction zone at 700°-860° F. temperature and 1500-3000 psig hydrogen partial pressure conditions, and precipitating the precipitable material on the catalyst in the bed;

(c) withdrawing used catalyst containing precipitated arsenic and iron contaminant from the first reaction zone;

(d) passing the reaction zone effluent on to a second reaction zone containing a fixed catalytic bed maintained at 750°-850° F. temperature for further hydrotreating the feed; and (e) recovering a hydrogen-containing gas stream and a hydrotreated shale oil liquid product stream.

* * * * *